US008161686B2

(12) United States Patent
Pedretti

(10) Patent No.: US 8,161,686 B2
(45) Date of Patent: Apr. 24, 2012

(54) PNEUMATIC STRUCTURAL ELEMENT, AND ROOF PRODUCED THEREFROM

(75) Inventor: Mauro Pedretti, Biasca (CH)

(73) Assignees: Prospective Concepts AG, Glattbrugg (CH); Airlight Limited (AG), Biasca (CH)

( * ) Notice: Subject to any disclaimer, the term of this patent is extended or adjusted under 35 U.S.C. 154(b) by 426 days.

(21) Appl. No.: 12/086,908

(22) PCT Filed: Dec. 22, 2006

(86) PCT No.: PCT/CH2006/000731

§ 371 (c)(1),
(2), (4) Date: Aug. 20, 2008

(87) PCT Pub. No.: WO2007/071100

PCT Pub. Date: Jun. 28, 2007

(65) Prior Publication Data

US 2010/0266796 A1 Oct. 21, 2010

(30) Foreign Application Priority Data

Dec. 23, 2005 (CH) ..... 2073/05

(51) Int. Cl.
*E04B 1/34* (2006.01)

(52) U.S. Cl. ..... 52/2.11; 52/2.13; 52/2.22

(58) Field of Classification Search ..... 52/2.11, 52/2.13, 2.18, 2.22–2.24; 135/127
See application file for complete search history.

(56) References Cited

U.S. PATENT DOCUMENTS 3,987,736 A * 10/1976 Miller ..... 410/119
4,275,869 A * 6/1981 Clements ..... 254/89 H
4,676,032 A * 6/1987 Jutras ..... 52/2.17
4,976,074 A 12/1990 Delamare et al.
5,027,564 A * 7/1991 Lechner ..... 52/2.23
6,065,252 A 5/2000 Norsen et al.
2002/0157322 A1* 10/2002 Pedretti ..... 52/2.13
2006/0260209 A1* 11/2006 Pedretti ..... 52/2.11
2006/0273233 A1* 12/2006 Pedretti et al. ..... 248/560
2007/0094937 A1* 5/2007 Pedretti ..... 52/2.11

FOREIGN PATENT DOCUMENTS

DE 1557401 9/1969

(Continued)

OTHER PUBLICATIONS

Delzor, Francois, International Search Report for PCT/CH2006/000/71 as mailed May 3, 2007 (6 pages).

*Primary Examiner* — Christine T Cajilig

(74) *Attorney, Agent, or Firm* — Winstead PC

(57) ABSTRACT

The pneumatic structural element comprises from one to a number of interconnected elements of the following construction: two hollow bodies made of textile material coated in a gas-type manner and each having two end caps are assembled such that they produce a common sectional area. The edging of this sectional area is formed by two curved tension/compression elements into which is clamped a gas-tight web made of a flexible material of high tensile strength. This web can be connected to the tension/compression elements in a gas-tight manner. By filling the two hollow bodies with compressed gas, a tensile stress σ pretensions said web. This pretensioning increases the bending rigidity of the tension/compression elements. If a plurality of such elements are combined to form a roof, every two adjacent hollow bodies thus form a sectional area with a tension/compression element and web.

15 Claims, 7 Drawing Sheets

FOREIGN PATENT DOCUMENTS

| | | | |
|---|---|---|---|
| EP | 1903559 | | 3/2008 |
| WO | WO 2004/083568 | * | 9/2004 |
| WO | WO 2005/007991 | * | 1/2005 |
| WO | WO-2005/007991 | | 1/2005 |
| WO | WO-2005/021898 | | 3/2005 |
| WO | WO-2005/042880 | | 5/2005 |

* cited by examiner

PNEUMATIC STRUCTURAL ELEMENT, AND ROOF PRODUCED THEREFROM

BACKGROUND

1. Field of the Invention

The present invention relates to a pneumatic structural element.

2. History of the Related Art

Beam-like pneumatic structural elements and also those having a surface formation have become increasingly known over the last few years. These are mostly attributed to EP 01 903 559 (D1). A further development of said invention is provided in WO 2005/007991 (D2). Here, the compression rod has been further developed into a pair of curved compression rods which can also absorb tensile forces and are therefore designated as tension/compression elements. These run along respectively one surface line of the cigar-shaped pneumatic hollow body. D2 is considered to be the nearest prior art.

The strong elevated bending rigidity of the tension/compression elements loaded with compressive forces is based on the fact that a compression rod used according to D2 can be considered as an elastically bedded rod over its entire length, wherein such a rod is bedded on virtual distributed elasticities each having the spring hardness k.

The spring hardness k is there defined by $$k=\pi\cdot p$$

where k=virtual spring hardness [N/m$^2$]

p=pressure in hollow body [N/m$^2$]

with the result that the bending load $F_k$ is obtained as $$F_k=2\sqrt{k\cdot E\cdot I}\,[N]$$

where

E=modulus of elasticity [N/m$^2$]

I=areal moment of inertia [m$^4$]

SUMMARY OF THE INVENTION

The object of the present invention is to provide a pneumatic structural element having tension/compression elements and an elongated gas-tight hollow body which can be formed and expanded into both curved and/or surface structures, having a substantially increased bending load $F_k$ compared with the pneumatic supports and structural elements known from the prior art.

BRIEF DESCRIPTION OF THE DRAWINGS

A more complete understanding of the device of the present invention may be obtained by reference to the following detailed description, taken in conjunction with the accompanying drawings, wherein.

DETAILED DESCRIPTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and fully convey the scope of the invention to those skilled in the art.

Figure 1:
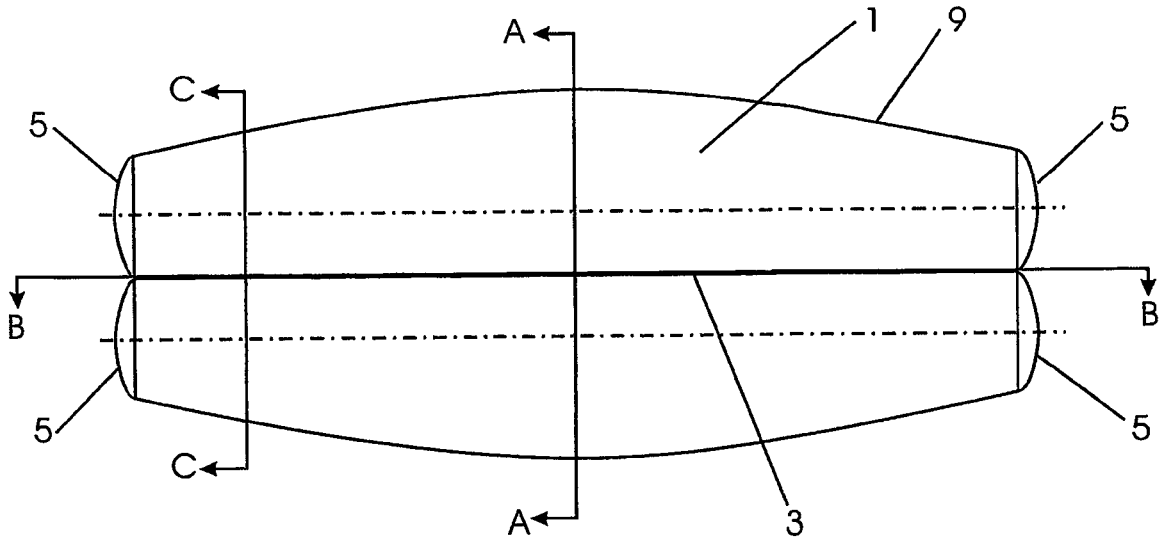
FIG. 1 shows a first exemplary embodiment of a pneumatic structural element according to the invention in plan view.

FIG. 1 shows the pneumatic structural element according to the invention in a first exemplary embodiment in plan view. It is formed from two elongated, for example, cigar-shaped gas-tight hollow bodies 1 comprising a casing 9 and respectively two end caps 5. The casing 9 in each case consists of a textile-laminated plastic film or of flexible plastic-coated fabric. These hollow bodies 1 intersect one another, abstractly geometrically, in a sectional area 2 as can be seen from FIG. 2, which forms a section BB through FIG. 1.

When the two hollow bodies 1 are filled with compressed gas, they acquire the form shown in section AA of FIG. 4, under the conditions described hereinafter. As a result of the pressure p in the interior of the hollow body 1, a linear stress a is built up in its casings 9, which is given by $$\sigma=p\cdot R$$

σ=linear stress [N/m]

p=pressure [N/m$^2$]

R=radius of the hollow body 1 [m]

Figure 3:
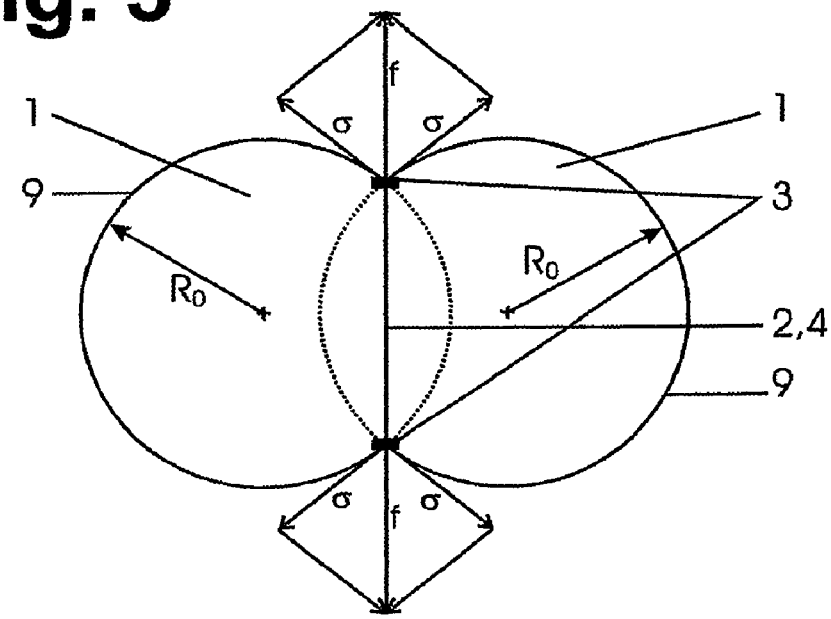
FIG. 3 shows a cross-section AA through the exemplary embodiment of FIG. 1 with the acting forces.

A textile web 4, for example, is inserted in the lines of intersection of the two hollow bodies 1, in the sectional area 2, to which the linear stresses a of the two hollow bodies 1 are transmitted in the line of intersection, as shown in FIG. 3. FIG. 3 shows the vectorial addition of the linear stresses a to the linear force fin the web 4:

$$\vec{f}=\vec{\sigma}_1+\vec{\sigma}_r$$

where $\vec{f}$=linear force in the web 4

$\vec{\sigma}_1$=linear stress in the left hollow body 1

$\vec{\sigma}_r$=linear stress in the right hollow body 1

For the same pressure p and the same radius R, the absolute magnitude of $\vec{f}$ is dependent on the angle of intersection of the two circles of intersection of the two hollow bodies 1.

Figure 2:
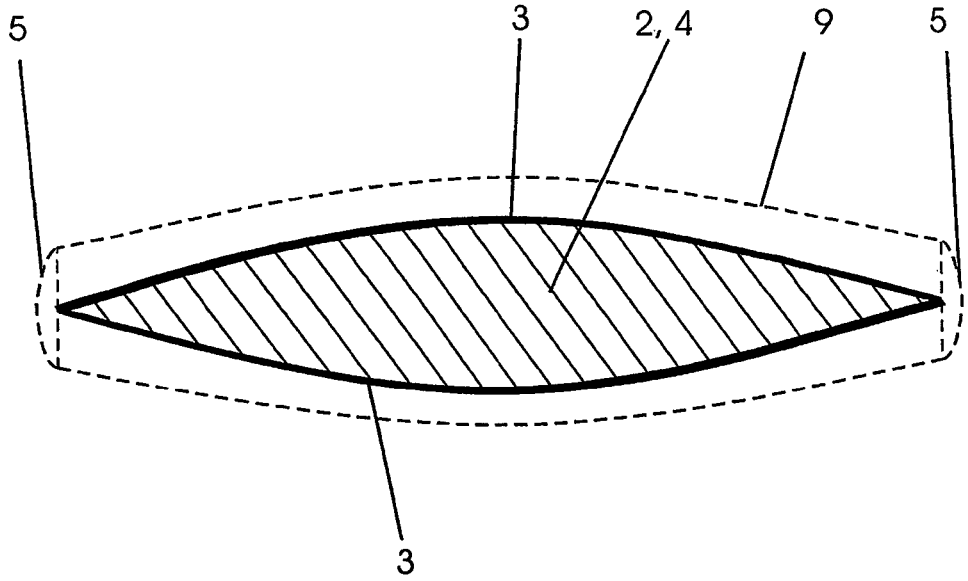
FIG. 2 shows the exemplary embodiment of FIG. 1 in longitudinal section BB.

In order to absorb tensile and compressive forces of the pneumatic structural element which have thus built up, the web 4 is clamped into a tension/compression element 3 having the form shown in FIG. 2. The tension/compression element 3 absorbs the part of this linear force determined by the vector addition, as shown above, and is thereby pre-tensioned in the direction given by the vector representation. By filling the hollow body 1 with compressed air, a pre-tensioning of the web 4 by the linear force $\vec{f}$ is obtained as $f=2\sigma \sin \phi$. Since the radius along the structural element is not generally constant, the pre-tensioning of the web along the structural element varies. By a suitable choice of the casing circumference and web height, the pre-tensioning of the web can be optimised according to the use of the pneumatic structural element or even made constant. The pre-tensioning of the web 4 is then $pR_0$, where 2R=diameter of the end caps 5.

This pre-tensioning brings about a behaviour of the tension/compression element 3 similar to a pre-tensioned string which only responds with a change in length when the pre-tensioning force is exceeded. Only when this pre-tensioning force is exceeded is there a risk of the tension/compression element 3 being bent. As a result of the indicated type of elastic bedding of the tension/compression element 3, the bending load $P_k$ is given by $$P_k \approx 3\frac{(EF)^{2/9}\cdot(EI)^{1/3}}{L^{2/9}}\cdot(p\cdot R_0)^{4/9}$$

where $P_k$=critical bending load

E=modulus of elasticity of the tension/compression element 3

F=cross-sectional area of the tension/compression element 3

I=areal moment of inertia of the tension/compression element 3 and

L=length of the tension/compression element 3.

In the pneumatic structural element according to the invention, therefore, the compressed air is used for pre-tensioning the flexible web so that this can transmit tensile and compressive forces and optimally stabilise the compression member against bending. The pneumatic structural element thus becomes more stable and light and is better able to bear local loads.

The tension/compression element 3 is laterally stabilised by the linear stresses 6 in the casing 9.

Figure 4:
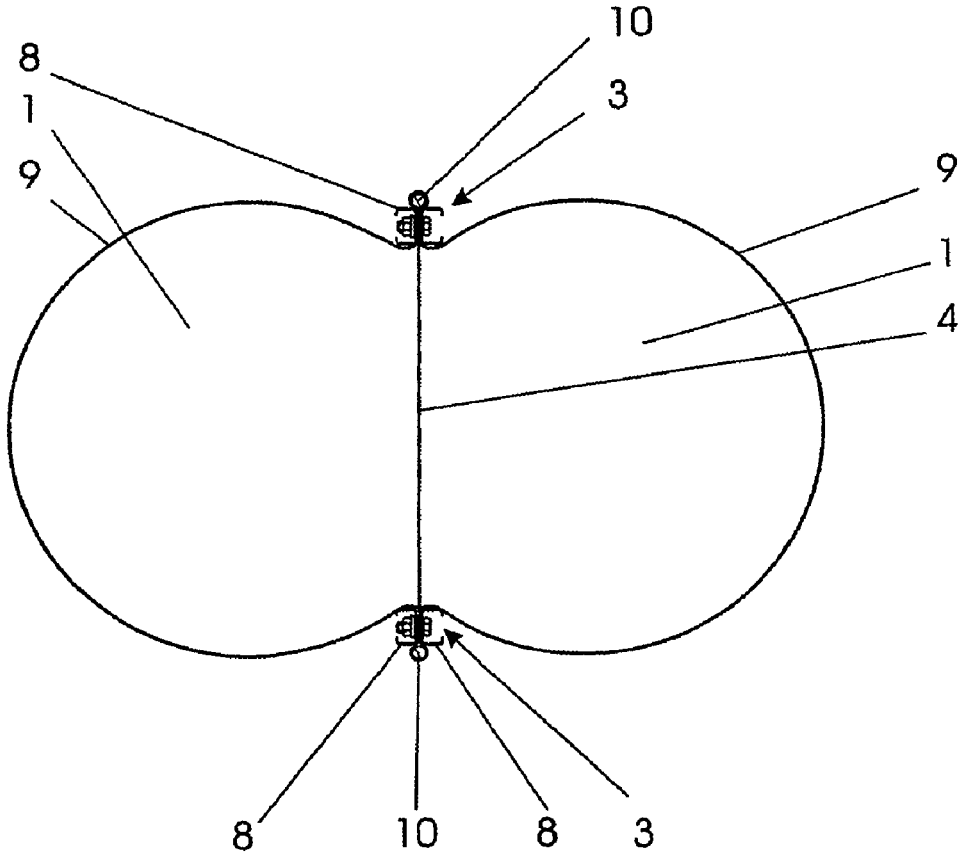
FIG. 4 shows the cross-section AA with an exemplary embodiment of a tension/compression element.

FIG. 4 shows a technical embodiment of the diagram according to FIG. 3 in the section AA according to FIG. 1. The tension/compression element 3 in this case, for example, consists of two C profiles 8 which have been screwed together. The casing 9 of the hollow body 1 is, for example, pulled between the C profiles 8 without interruption and is secured externally on the tension/compression element 3 by means of a beading 10. The web 4 is inserted between the external layers of the casing 9 and is clamped securely by the screw connection of the C profiles 8.

Figure 5A:
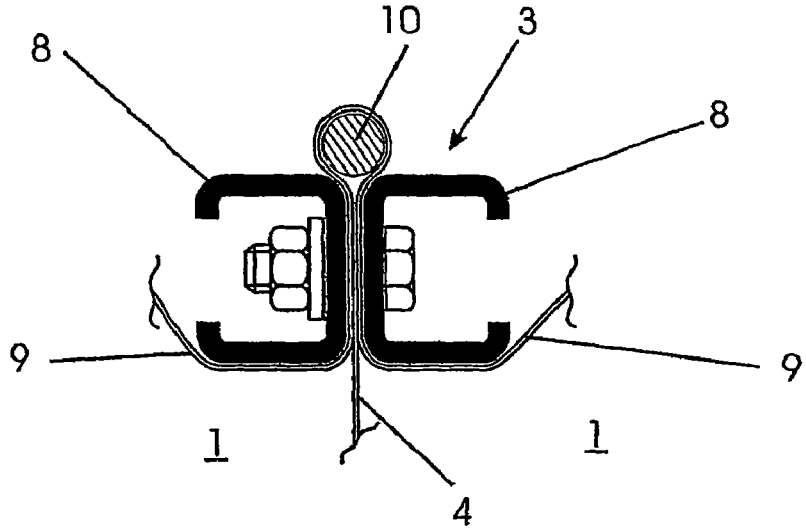
FIG. 5A shows a cross-section through a first exemplary embodiment of a tension/compression element in detail.

FIG. 5A shows a section through the tension/compression element 3 thus executed in detail.

Figure 5B:
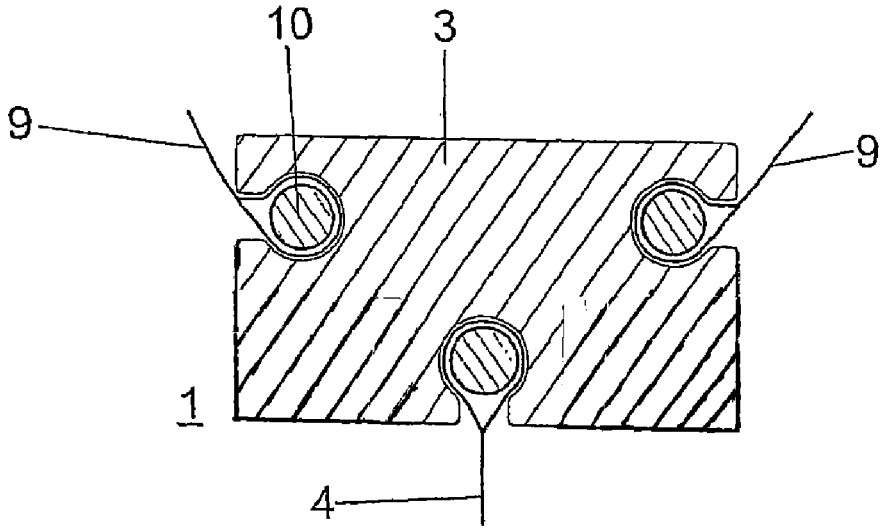
FIG. 5B is a cross-sectional view of a tension/compression element according to an exemplary embodiment.

FIG. 5B is a cross-sectional view of a tension/compression element according to an exemplary embodiment. In an exemplary embodiment, each tension compression element 3 consists of a profile rod having three grooves for receiving beading 10. Two grooves are disposed laterally and one groove is disposed centrally. The casing 9 is clamped by the lateral beading 10 and the web 4 is clamped by the centrally disposed beading 10.

Figure 5C:
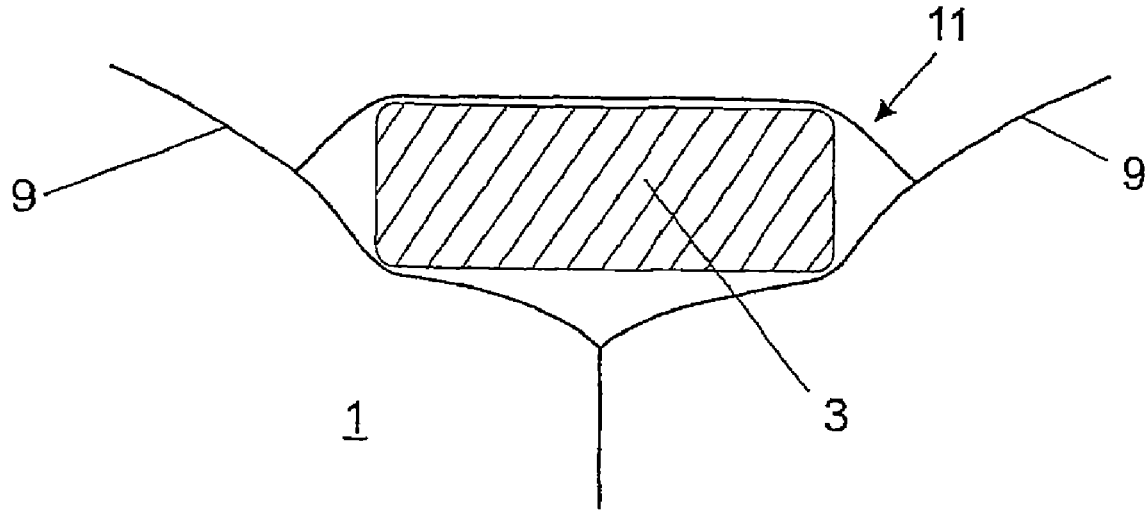
FIG. 5C is a cross-sectional view of a tension/compression element according to an exemplary embodiment.

FIG. 5C is a cross-sectional view of a tension/compression element according to an exemplary embodiment. In a typical embodiment, each tension/compression element 3 consists of a profile rod having a suitable areal moment of inertia. Each profile rod is inserted in a pocket 11 running longitudinally to the tension/compression element 3. The casing 9 of the hollow body 1 is connected to this pocket in a gas-tight manner. The web is likewise connected to the pocket 11. The connections of the casing 9 and the web 4 to the pocket 11 are produced by welding or adhesive bonding or sewing with subsequent sealing. In various embodiments, the connection between the pocket 11 and the web 4 is made in a gas-tight manner. In various embodiments, means are provided for guiding the tension/compression elements 3 in a gas-tight manner out from the hollow bodies 1. The nodes 14 are disposed outside the hollow body 1.

Figure 6:
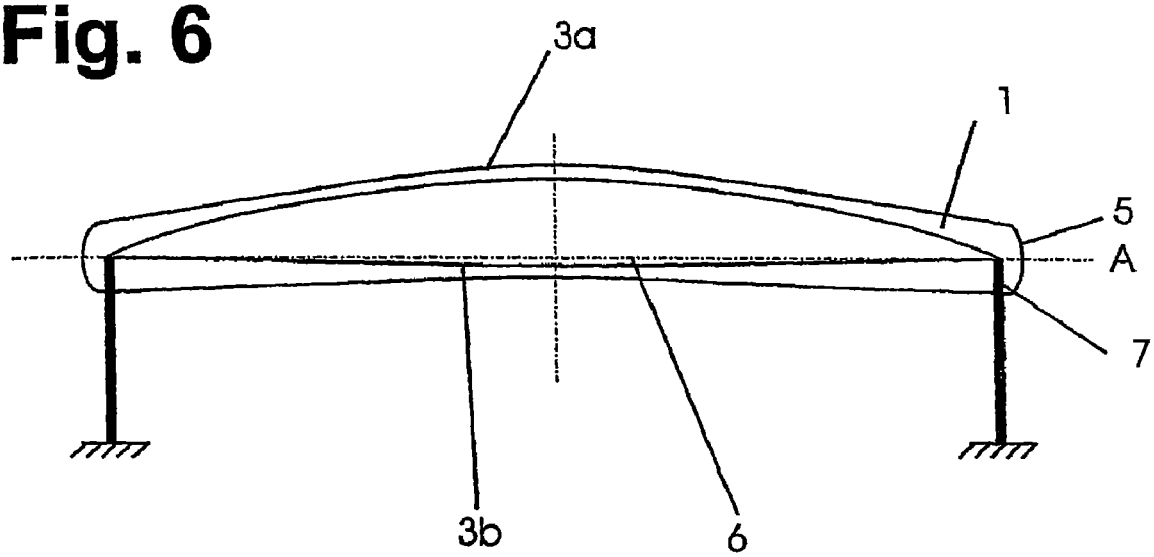
FIG. 6 shows a second exemplary embodiment of a pneumatic structural element in side view.

FIG. 6 shows a side view of a second exemplary embodiment of a pneumatic structural element according to the present invention. Compared to that of FIGS. 1 and 2, this is upwardly arched, its longitudinal axis, designated here with numeral 6, therefore now lying closer to the lower tension/compression element 3 designated as 3*b* than to the upper tension/compression element designated as 3*a*. The forces are derived via two supports 7 which absorb both vertical compressive and also tensile forces.

The ratio of length to height of the pneumatic structural elements shown in FIG. 4 is about 15.

Figure 7A:
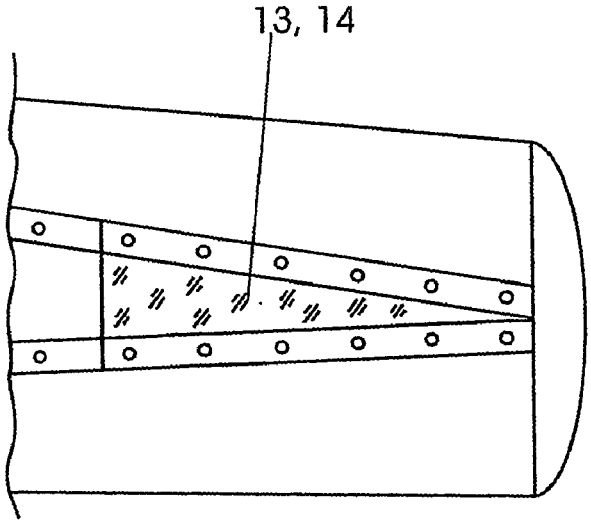
FIGS. 7*a, b* shows the region of one end of a pneumatic structural element according to FIG. 6.

FIGS. 7*a, b* show diagrams of one end of a pneumatic structural element according to the invention, for example, from FIG. 6; the end not shown is preferably executed mirror-symmetrically. At the ends of the tension/compression element 3, the two tension/compression elements are brought together and there form a node 14. This is produced by replacing the web 4, for example, by a plate 13 which transmits the necessary forces from and to the tension/compression elements 3. Depending on the tension/compression elements used however, such a solution can be differently configured for transmitting forces. These are accessible to the person skilled in the art without particular expense.

Figure 7B:
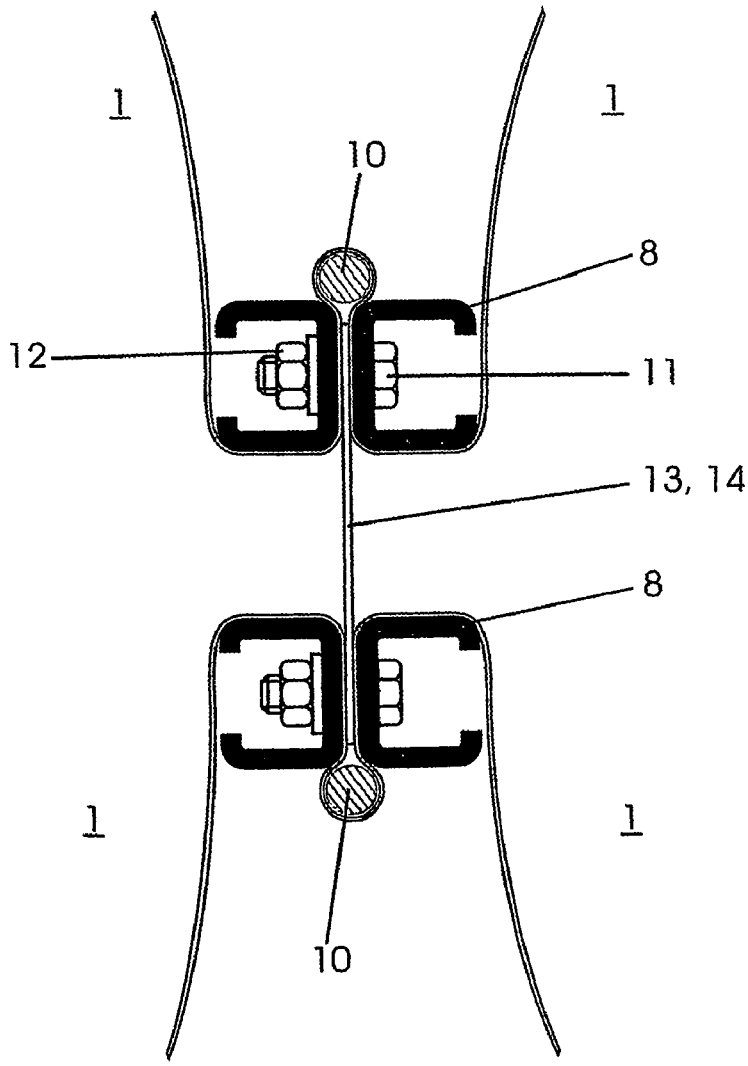

FIG. 7*a* shows a side view of the node 14 and FIG. 7*b* shows a cross-section.

Figure 8:
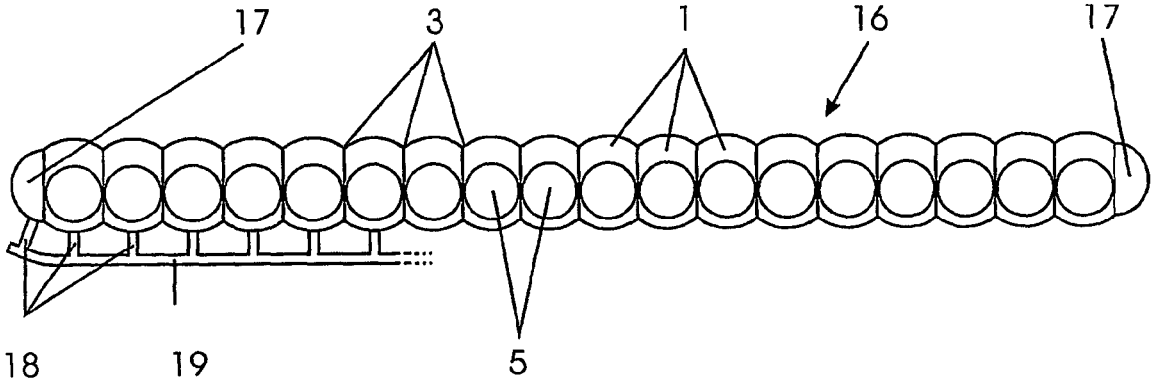
FIG. 8 shows a cross-section through a roof element according to the invention.
Figure 9:
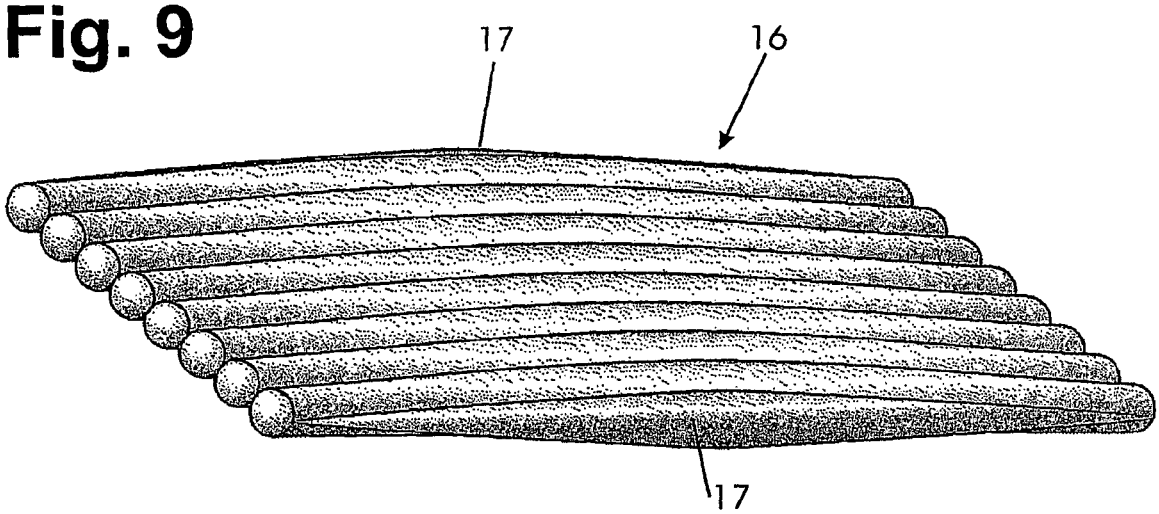
FIG. 9 shows a roof element according to FIG. 8 in isometric projection.

FIG. 8 shows the front view of a roof element 16 composed of a plurality of structural elements according to FIG. 1. In each case, these are assembled at a tension/compression element 3 located between the hollow bodies 1. The spacing of the tension/compression elements 3 is in each case $2R_0$, the diameter of the end caps 5. A roof element 16 according to FIGS. 7*a* and 7*b* can be placed on a suitable supporting structure. As long as the supporting surface is substantially flat, the type of support is non-critical: it is not necessary to place the roof element 16 on the tension/compression elements 3; it can also be placed on the hollow body 1 as long as there is no risk of injury. In order to erect a roof consisting of one or more roof elements 16, such a roof element 16 is joined together, in an assembly hall for example, from tension/compression elements 3, the webs 4 and the casings 9 of the hollow body 1. Each hollow body 1, with a gas-tight web 4, has its own connection 18 for the compressed gas. These connections 18 are usually placed on a common compressed gas line 19 so that all the hollow bodies 1 have the same gas pressure.

After assembling these said individual parts, the entire roof element 16 can be transported to the building site, on a lorry for example, and placed under gas pressure there. The roof element that is now stabilised by the compressed gas is placed on the provided and prepared support by means of a crane and secured there.

Lateral terminations 17 are located at the lateral ends of a roof element 16. These also consist of hollow bodies 1 as shown in FIG. 8. Their maximum diameter substantially corresponds to the lateral spacing of respectively two tension/compression elements 3. The form profile of the lateral terminations 17 can be seen from FIG. 8.

For large roofs a plurality of identical roof elements 16 can be placed adjacent to one another and in each case secured to one another at the outermost tension/compression elements 3.

Figure 10:
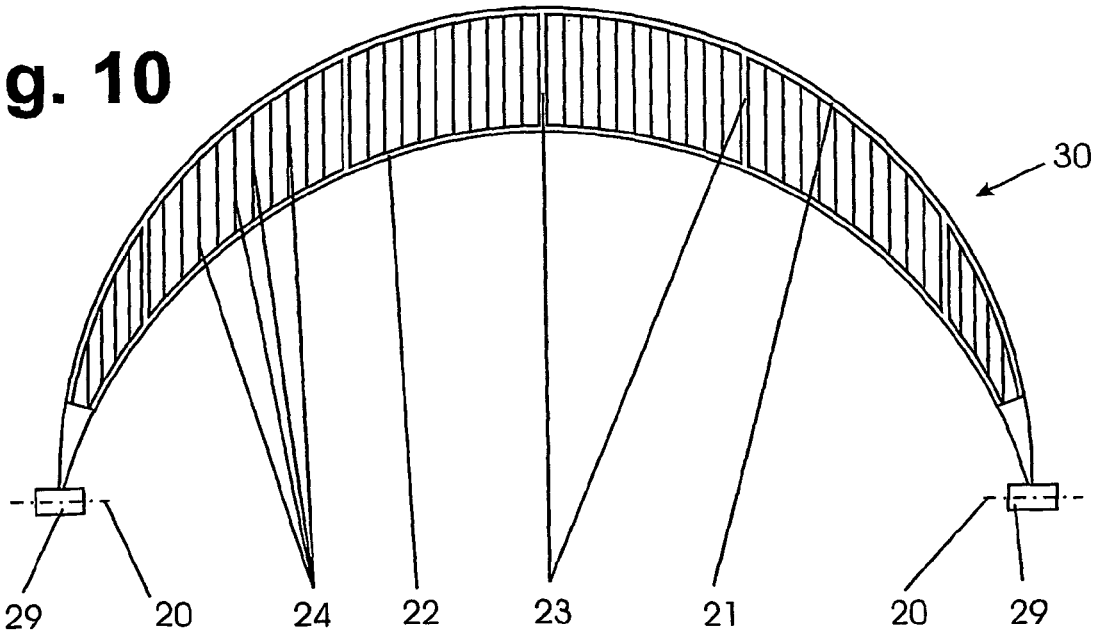
FIGS. 10, 11, 12 show an exemplary embodiment of the invention as elements of a domed roof.
Figure 11:
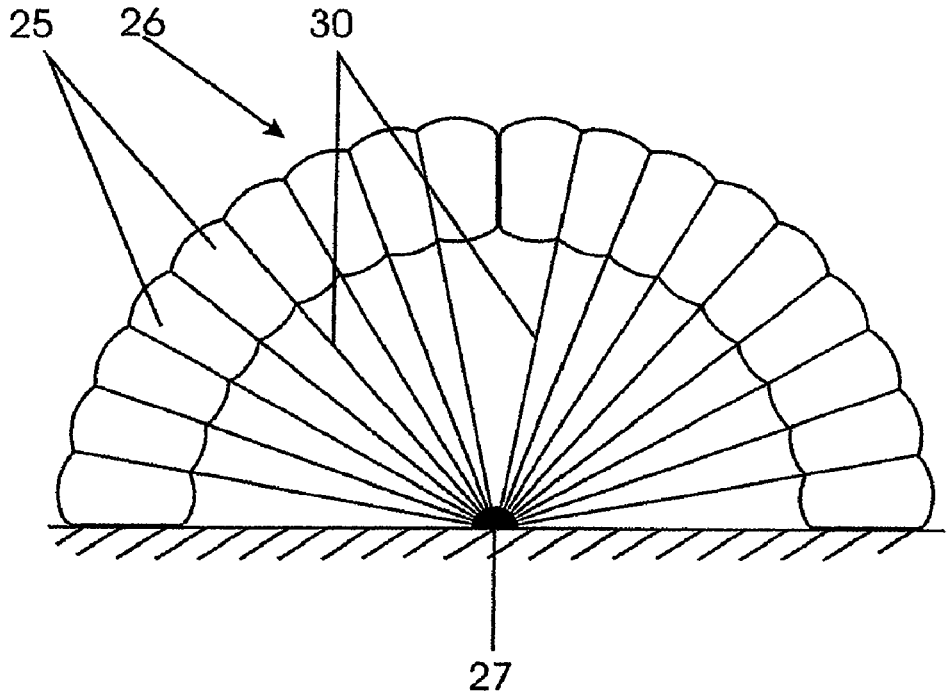
Figure 12:
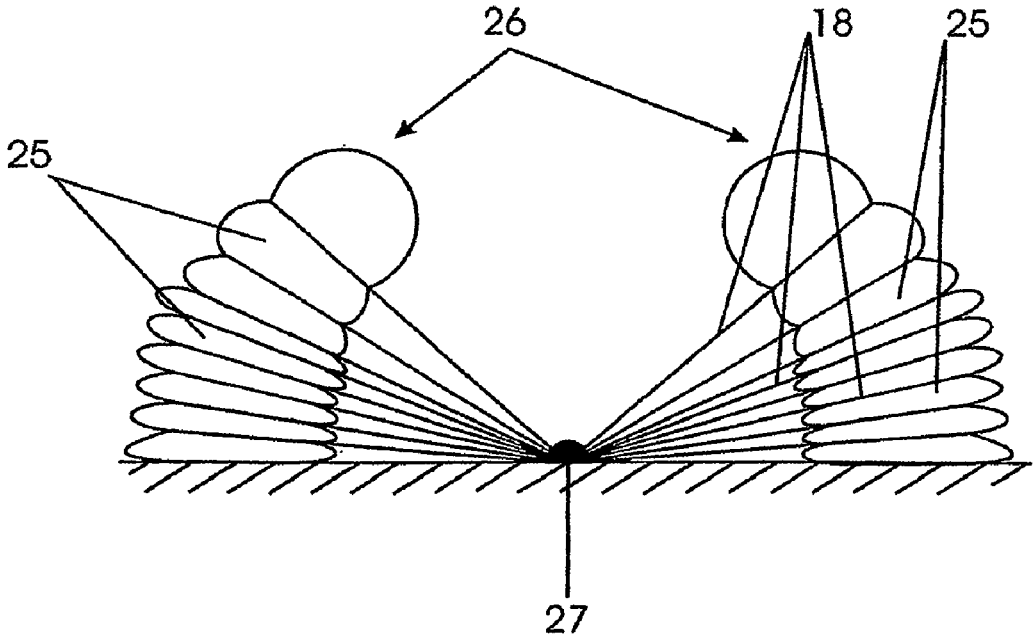

FIGS. 10, 11 and 12 show a third exemplary embodiment of a pneumatic structural element according to the invention. FIG. 10 shows a curved tension/compression element 30 which rests on two pivot bearings 29 on a pivot axis 20 and is pivotable about said axis. The curved tension/compression element 30 comprises an outer arc 21 and an inner arc 22. These arcs 21, 22 are connected by a number, for example five, of struts 23 which are parallel to one another and by a plurality of tension wires 24 and are thus pre-stabilised without pneumatic hollow bodies. Again, as in the exemplary embodiment of FIGS. 1, 2, a web 4 is inserted parallel to the family of tension wires 24 and is secured to the arcs 21, 22 by means of a beaded connection.

FIG. 10 shows a dome-shaped roof 26 erected on curved pneumatic structural elements 25. Similarly to the first exemplary embodiment according to FIGS. 1 and 2, a number, for example eighteen, of hollow bodies 1 is produced and connected to the curved tension/compression elements 30 as shown. As executed for the roof element 16, the roof 26 can be prefabricated in an assembly hall. On the building site, a node 27 must be secured or concreted in the ground. At their ends, the curved tension/compression elements 30 each have a connection, not shown, which allows the curved tension/compression elements 30 to be pivotally mounted about the axes 20. Numerous solutions are known for this in construction engineering. After being transported to the building site, said connections are made at the node 27.

The dome-shaped roof 26 is now erected by filling the individual curved structural elements 25 with compressed gas. Since all the connections 18, as implemented in FIGS. 7*a* and 7*b*, are connected to a common compressed gas line 19, the uppermost structural element 25 will initially assume the round shape, successively followed by those located thereunder. The roof 26 is divided into two halves, which seal the roof tightly when completely filled.

Alternatively, the termination can be made by two curved tension/compression elements 30 which can be closed together, instead of by hollow bodies 1. For this purpose, a plurality of pneumatically or electrically actuated closure mechanisms (not shown) are distributed on said tension/compression elements 30. Numerous solutions are known for this in mechanical engineering.

Although various embodiments have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention as set forth herein.

The invention claimed is:

1. A pneumatic structural element comprising:

at least two elongated hollow bodies, each of the at least two elongated hollow bodies comprising a gas-tight casing of flexible material;

at least two tension/compression elements, the at least two tension/compression elements disposed between the at least two elongated hollow bodies and being continuous over a length of the gas-tight casing of flexible material, the at least two tension/compression elements being connected to each other at a node at respective ends of the at least two tension/compression elements;

a web of high-tensile-strength material extending between the at least two tension/compression elements disposed between the at least two elongated hollow bodies, the web extending along a length of the at least two elongated hollow bodies, the web being connected along an upper longitudinal edge and a lower longitudinal edge to the gas-tight casing, the web being tensioned responsive to pressurization of the at least two elongated hollow bodies;

wherein, responsive to a transverse-acting load, a first tension/compression element of the at least two tension/compression elements, on a same side of the transverse-acting load, is axially compressed and a second tension/compression element of the at least two tension/compression elements, on an opposite side of the transverse-acting load, is axially tensioned; and wherein, responsive to the transverse-acting load, axial compression and tension forces are transmitted between the first tension/compression element and the second tension/compression element through the node.

2. The pneumatic structural element according to claim 1, wherein:

the web comprises flexible gas-tight material; and the web is secured in a gas-tight manner to the at least two tension/compression elements and defines a first elongated hollow body and a second elongated hollow body of the at least two elongated hollow bodies.

3. The pneumatic structural element according to claim 2, wherein the flexible gas-tight material is a plastic film.

4. The pneumatic structural element according to claim 2, wherein the flexible gas-tight material is a plastic-coated textile material.

5. The pneumatic structural element according to claim 1, wherein each tension/compression element of the at least two tension/compression elements comprises:

first and second C-shape profiles which are screwed to one another;

a bead operatively coupled to the web and disposed on an outside of at least one tension/compression element of the at least two tension/compression elements; and wherein the web is clamped between the first and second C-shape profiles by a screw connection.

6. The pneumatic structural element according to claim 1, wherein:

each tension/compression element of the at least two tension/compression elements comprises a profile rod having a first groove, a second groove, and a third groove;

wherein the first groove and the second groove are disposed laterally and the third groove is disposed centrally;

the gas-tight casing is clamped by the first groove and the second groove; and the web is clamped by the third groove.

7. The pneumatic structural element according to claim 1, wherein:

each tension/compression element of the at least two tension/compression elements comprises a profile rod;

the profile rod is inserted in a pocket disposed longitudinally to the at least two tension/compression elements;

the gas-tight casing of the at least two elongated hollow bodies is connected to the pocket in a gas-tight manner;

the web is connected to the pocket; and the gas-tight casing and the web are connected to the pocket via at least one of welding, adhesive bonding, or sewing with subsequent sealing.

8. The pneumatic structural element according to claim 7, wherein the pocket and the web are connected in a gas-tight manner.

9. The pneumatic structural element according to claim 1, wherein:

the at least two tension/compression elements are guided in a gas-tight manner out from the at least two elongated hollow bodies; and the node is disposed outside the at least two elongated hollow bodies.

10. A roof element, comprising:

a plurality of elongated hollow bodies, each elongated hollow body of the plurality of elongated hollow bodies comprising a gas-tight casing of flexible material;

a plurality of tension/compression elements, the plurality of tension compression elements being arranged in pairs, each pair of tension/compression elements comprising a first continuous tension/compression element disposed over a length of the gas-tight casing and a second continuous tension/compression element disposed over the length of the gas-tight casing, the first continuous tension/compression element and the second continuous tension/compression being connected to each other at a node, each said pair being disposed between successive elongated hollow bodies of the plurality of elongated hollow bodies;

a web of high-tensile-strength material extending between each said pair of tension/compression elements, the web being connected along a longitudinal edge to the gas tight casing, the web extending along a length of the successive elongated hollow bodies of the plurality of elongated hollow bodies, the web being tensioned responsive to pressurization of the plurality of elongated hollow bodies;

wherein at least one elongated hollow body of the plurality of elongated hollow bodies is disposed between each said pair, the at least one elongated hollow body being connected to the first continuous tension compression element and the second continuous tension/compression element in a gas-tight manner;

wherein the plurality of elongated hollow bodies comprises a connection for compressed gas;

wherein, responsive to a transverse-acting load, the first continuous tension/compression element is axially compressed and the second continuous tension/compression element is axially tensioned; and wherein, responsive to the transverse-acting load, axial compression and tension forces are transmitted between the first continuous tension/compression element and the second continuous tension/compression element through the node.

11. The roof element according to claim 10, wherein:

Each said pair of tension/compression elements is arranged substantially parallel to one another; and at least two tension/compression elements of the plurality of tension/compression elements bear an unpaired elongated hollow body.

12. The roof element according to claim 10, wherein:

the plurality of tension/compression elements comprise an outer arc and an inner arc connected by the node;

each said pair of tension/compression elements are connected by a first plurality of struts and a plurality of tension wires, the first plurality of struts being parallel to one another, the plurality of tension wires being parallel to one another and to the first plurality of struts;

the plurality of tension/compression elements are pre-stabilised;

the web is inserted between the outer arc and the inner arc and is connected in a gas-tight manner to the plurality of tension/compression elements;

one elongated hollow body of the plurality of elongated hollow bodies is inserted between each said pair of tension/compression elements and is connected to each said pair of tension/compression elements in a gas-tight manner;

each tension/compression element of the plurality of tension/compression elements has a connection at the node allowing connection in an articulated manner to a second node;

the second node comprises an axis on which the plurality of tension/compression elements are pivotally mounted;

the plurality of elongated hollow bodies are formed in two groups of substantially the same size;

the plurality of tension/compression elements are dimensioned such that when the plurality of elongated hollow bodies are filled with a compressed gas, said plurality of elongated hollow bodies can form a closed domed roof; and the plurality of elongated hollow bodies comprise at least one connection for compressed gas.

13. The roof element according to claim 10, wherein the connection for compressed gas is disposed on a common compressed gas line such that each elongated hollow body of the plurality of elongated hollow bodies have the same gas pressure.

14. The pneumatic structural element according to claim 12, wherein:

at least two tension/compression elements of the plurality of tension/compression elements bear an unpaired hollow body of the plurality of elongated hollow bodies; and pre-tensioning of the web is symmetrical and the at least two tension/compression elements of the plurality of tension/compression elements are laterally stabilised.

15. The roof element according to claim 12, further comprising:

at least two outermost movable tension/compression elements of the plurality of tension/compression elements, the at least two outermost movable tension/compression elements are terminated by the web; and wherein the at least two outermost movable tension/compression elements comprise at least one closure mechanism for locking the at least two outermost movable tension/compression elements with one another.

* * * * *

UNITED STATES PATENT AND TRADEMARK OFFICE

CERTIFICATE OF CORRECTION

PATENT NO. : 8,161,686 B2
APPLICATION NO. : 12/086908
DATED : April 24, 2012
INVENTOR(S) : Mauro Pedretti It is certified that error appears in the above-identified patent and that said Letters Patent is hereby corrected as shown below:

In the Specifications:

COLUMN 3, LINE 8

Replace "2R=diameter"
With -- $2R_0$=diameter --

COLUMN 3, LINE 40

Replace "linear stresses 6 in the casing 9."
With -- linear stresses σ in the casing 9. --

Signed and Sealed this
Fourth Day of September, 2012

David J. Kappos

David J. Kappos
*Director of the United States Patent and Trademark Office*